US010717131B2

(12) United States Patent
Nagata et al.

(10) Patent No.: US 10,717,131 B2
(45) Date of Patent: Jul. 21, 2020

(54) METHOD OF MANUFACTURING A RARE EARTH MAGNET ALLOY POWDER, A RARE EARTH MAGNET MADE THEREFROM AND A POWDER MAKING DEVICE

(71) Applicants: XIAMEN TUNGSTEN CO., LTD., Fujian (CN); Fujian Changting Golden Dragon Rare-Earth Co., Ltd, Fujian Province (CN)

(72) Inventors: Hiroshi Nagata, Tokyo (JP); Chonghu Wu, Xiamen (CN)

(73) Assignees: XIAMEN TUNGSTEN CO., LTD., Fujian (CN); FUJIAN CHANGTING GOLDEN DRAGON RARE-EARTH CO., LTD, Fujian Province (CN)

( * ) Notice: Subject to any disclaimer, the term of this patent is extended or adjusted under 35 U.S.C. 154(b) by 164 days.

(21) Appl. No.: 15/937,795

(22) Filed: Mar. 27, 2018

(65) Prior Publication Data

US 2018/0281072 A1 Oct. 4, 2018

Related U.S. Application Data

(63) Continuation of application No. 14/427,159, filed as application No. PCT/CN2013/083238 on Sep. 10, 2013, now abandoned.

(30) Foreign Application Priority Data

Sep. 12, 2012 (CN) ..... 2012 1 0336861
Sep. 12, 2012 (CN) ..... 2012 1 0339562

(51) Int. Cl.
*B22F 9/04* (2006.01)
*H01F 1/057* (2006.01)
(Continued)

(52) U.S. Cl.
CPC ..... *B22F 9/04* (2013.01); *H01F 1/0536* (2013.01); *H01F 1/0571* (2013.01);
(Continued)

(58) Field of Classification Search
CPC ..... B22F 2009/044; B22F 2998/10; B22F 2201/10; B22F 3/1017; B22F 9/04; H01F 1/0536; H01F 1/0571
(Continued)

(56) References Cited

U.S. PATENT DOCUMENTS 4,602,743 A * 7/1986 Nied ..... B02C 19/068 241/5
4,992,234 A * 2/1991 Ohashi ..... C22C 1/0441 252/62.55
(Continued)

FOREIGN PATENT DOCUMENTS

CN 103215467 * 7/2013

OTHER PUBLICATIONS

S. Larrabee, Controlled Atmosphere Chambers, Induction Heating and Heat Treatment. vol. 4C, ASM Handbook, ASM International, 2013, p. 691-700 (Year: 2013).*

*Primary Examiner* — Colleen P Dunn
*Assistant Examiner* — Nicholas A Wang
(74) *Attorney, Agent, or Firm* — Cooper Legal Group, LLC

(57) ABSTRACT

The present invention discloses a method of manufacturing, powder making device for rare earth magnet alloy powder, and a rare earth magnet. The method comprises a process of fine grinding at least one kind of rare earth magnet alloy or at least one kind of rare earth magnet alloy coarse powder in inert jet stream with an oxygen content below 1000 ppm to obtain powder that has a grain size smaller than 50 μm. Low oxygen content ultra-fine powder having a grain size smaller than 1 μm is not separated from the pulverizer, and the oxygen content of the atmosphere is reduced to below 1000 ppm in the pulverizer when crushing the powder. Therefore, abnormal grain growth (AGG) rarely happens in the sintering process. A low oxygen content sintered magnet is
(Continued)

obtained and the advantages of a simplified process and reduced manufacturing cost are realized.

20 Claims, 3 Drawing Sheets

(51) Int. Cl.
*H01F 1/053* (2006.01)
*H01F 41/02* (2006.01)
*B22F 9/02* (2006.01)

(52) U.S. Cl.
CPC ..... *H01F 41/0266* (2013.01); *B22F 9/023* (2013.01); *B22F 2009/044* (2013.01); *B22F 2009/045* (2013.01); *B22F 2998/10* (2013.01); *B22F 2999/00* (2013.01); *H01F 1/0577* (2013.01)

(58) Field of Classification Search
USPC ..... 419/23
See application file for complete search history.

(56) References Cited

U.S. PATENT DOCUMENTS 6,403,024 B1* 6/2002 Oota ..... B22F 9/023 241/30
2002/0020469 A1* 2/2002 Okayama ..... H01F 1/0573 148/29
2002/0117237 A1* 8/2002 Takaki ..... H01F 1/0577 148/302
2003/0124050 A1* 7/2003 Yadav ..... A62C 31/03 423/592.1
2008/0247898 A1* 10/2008 Nakamura ..... B22F 3/24 419/9
2008/0251159 A1* 10/2008 Odaka ..... B22F 9/002 148/121
2010/0143178 A1* 6/2010 Nakajima ..... B22D 11/001 420/72
2012/0032764 A1* 2/2012 Kuniyoshi ..... C22C 1/0441 335/302
2012/0137829 A1* 6/2012 Harris ..... C22B 7/002 75/363
2014/0328711 A1* 11/2014 Sun ..... B22F 1/0081 419/20

* cited by examiner

METHOD OF MANUFACTURING A RARE EARTH MAGNET ALLOY POWDER, A RARE EARTH MAGNET MADE THEREFROM AND A POWDER MAKING DEVICE

RELATED APPLICATIONS

This application is a continuation of and claims priority to U.S. patent application Ser. No. 14/427,159, titled "MANUFACTURING METHOD OF RARE EARTH MAGNET ALLOY POWDER, RARE EARTH MAGNET AND A POWDER MAKING DEVICE" and filed on Mar. 10, 2015, which is a national stage filing of PCT/CN2013/083238, filed on Sep. 10, 2013, which claims priority to Chinese Patent Application 201210336861.8, filed on Sep. 12, 2012, and Chinese Patent Application 201210339562.X, filed on Sep. 12, 2012. U.S. patent application Ser. No. 14/427,159, PCT/CN2013/083238, and Chinese Patent Applications 201210336861.8 and 201210339562.X are incorporated herein by reference.

BACKGROUND OF THE INVENTION

1. Field of the Invention

The present invention relates to the field of magnet manufacturing, especially to a method of manufacturing rare earth magnet alloy powder, a rare earth magnet and a powder making device for rare earth magnet alloy powder.

2. Background of the Related Prior Art

A rare earth magnet is based on an intermetallic compound $R_2T_{14}B$, where, R is rare earth element, T is iron or a transition metal element to replace the iron or part of the iron, B is boron. This magnet is known as the king of magnets and has excellent magnetic properties. The max magnetic energy product (BH) max is ten times higher than that of a ferrite magnet (Ferrite). In addition, this rare earth magnet has a good machining property, the operation temperature can reach 200° C., it is hard, stable, and has good cost performance and wide applicability.

There are two types of rare earth magnets depending on the manufacturing method: a sintered magnet and a bonded magnet. The sintered magnet has wider applications. In existing known technology, the sintering method for a rare earth magnet is normally performed as follows: raw material preparing→melting→casting→hydrogen decrepitation→micro grinding→pressing under a magnetic field→sintering→heat treatment→magnetic property evaluation→oxygen content evaluation of the sintered magnet.

In the method of manufacturing a rare earth magnet, the powder making process is usually accomplished by a jet milling method, such as micro grinding of the rare earth magnet alloy. It is generally believed that it is appropriate to classify and remove the oxidized R-rich ultra-fine powder (smaller than 1 μm) that accounts for 0.3~3% of the production when using the jet milling method. This R-rich ultra-fine powder is easier to oxidize compared to other powders with less rare earth element R content (with larger grain size). The rare earth element will be oxidized significantly if the R-rich ultra-fine powder is not removed in the sintering process, which leads to consummation of rare earth element R combined with oxygen, resulting in lowering the production of the main $R_2T_{14}B$ crystal phase.

FIG. 1 is a powder making device used in the jet milling method. The oxygen content of the gas atmosphere is about 10000 ppm during the crushing process. The device comprises a pulverizer 1', a classification device 2', a powder collecting device 3', an ultra-fine powder collecting device 4' and a compressor 5'. The pulverizer 1' is disposed with a filter 11' that is connected to the air outlet of the pulverizer 1'. The air inlet of the pulverizer 1' is connected to the compressor 5' via a pipe, the air outlet of the pulverizer 1' is connected to the classification device 2' via a pipe, and the classification device 2' is connected to the powder collecting device 3' and the ultra-fine powder collecting device 4', respectively. In the powder making process, the coarse powder (as raw material) is put into the pulverizer 1' through the raw material inlet, the coarse powder (raw material) is crushed by the jet milling method in the pulverizer 1'. Powder having a grain size smaller than the target grain size is delivered to the classification device 2' via a pipe for classification along with the filtering of the filter 11'. The uncrushed powder or imperfectly crushed powder are kept in the pulverizer 1' for further jet mill crushing, in the classification device 2', by the classification process. The ultra-fine powder enters the ultra-fine powder collecting device 4' via a pipe after the classification process, the final powder enters the powder collecting device 3' for subsequent processing, and the gas and the ultra-fine powder are separated in the ultra-fine powder collecting device 4'. The air outlet of the ultra-fine powder device 4' is connected to the compressor 5' via a pipe, the gas recycles via compressor 5', and ultra-fine powder is kept in the ultra-fine powder collecting device 4', in this powder making process. The ultra-fine powder collected by the ultra-fine powder collecting device 4' is usually thrown-away in this powder making process. The oxygen content of the sintered magnet obtained from the above method is around 2900 ppm~5300 ppm.

On the other hand, oxidation rarely happens during the forming and sintering process due to the development of anti-oxidant techniques. Thus, the oxygen content of the magnet mainly depends on the large tonnage of gas in the jet milling process. A high performance sintered magnet with an oxygen content reduced to below 2500 ppm can be obtained when the oxygen content during jet milling is reduced to lower than 1000 ppm. However, over sintering may happen in the sintering process with a low oxygen content, which leads to an abnormal grain growth (AGG) problem. Further, problems of low coercivity, poor squareness, and heat resistance will be more significant. Usually, 0.5%~1% weight of Ga, Zr, Mo, V, W, etc. is added to prevent abnormal grain growth, but these elements are non-magnetic elements, which not only makes the process complicated and increase cost but also leads to low Br, (BH) max of the magnet.

The object of the present invention is to overcome the disadvantages of the existing known technology and provide a method of manufacturing of rare earth magnet alloy powder, without the separation of low oxygen content ultra-fine powder with grain size smaller than 1 μm from the pulverizer.

Another object of the present invention is to provide a method of manufacturing a rare earth magnet.

Another object of the present invention is to provide a powder making device for rare earth magnet allow powder.

SUMMARY OF THE INVENTION

The object is accomplished by reducing oxygen content of the atmosphere to below 1000 ppm in the pulverizer when crushing the powder, so that abnormal grain growth (AGG) rarely happens in the sintering process. A low oxygen content sintered magnet is obtained and the advantages of a simplified process and reduced manufacturing cost are realized.

The technical proposal of the present invention follows.

A method of manufacturing rare earth magnet alloy powder for a rare earth magnet comprising a $R_2T_{14}B$ main phase, where R is at least one kind of rare earth element comprising yttrium, T is at least one kind of transition metal element comprising Fe and/or Co, wherein the method comprises a process of fine grinding at least one kind of rare earth magnet alloy or at least one kind of rare earth magnet alloy coarse powder in an inert jet stream with an oxygen content below 1000 ppm to obtain powder that has a grain size smaller than 50 μm, the powder including ultra-fine powder with a grain size smaller than 1 μm.

The present invention no longer separates and discards the ultra-fine powder (with grain size smaller than 1 μm) from the low oxygen content powder, and the total oxygen content of the powder is 1000~2000 ppm due to adjusting the oxygen content of the inert jet steam, so that abnormal grain growth (AGG) rarely happens in the sintering process to get a low oxygen content sintered magnet. The coercivity is not reduced with about 40° C. of variability in the sintering temperature. In the performance aspect, compared to a sintered magnet formed from powder in which the ultra-fine is powder is separated, the coercivity can be increased 12%, squareness can be increased a maximum of 15%, and valuable rare earths are saved, thus contributing to pricing.

The un-separated ultra-fine powder of the present invention means that the total powder from jet milling is used in the subsequent process. The total powder includes almost all powder, including the ultra-fine powder to make a magnet product. It will be appreciated that residual powder (a small amount of powder residue in the pulverizer, classifying roller, pipe, compressor, pressure container, connector of valve and the powder container, as well as sample powder for analyzing, forming test and QC) may not be included in the total powder. It also means that the ultra-fine powder separated and discarded in the existing technology is effectively used in the present invention.

The grain size is the grain size of each particle. Smaller than 50 μm means the grain size of each particle doesn't exceed 50 μm. In other words, it is a crystal grain group with maximum grain size smaller than 50 μm, but the group also contains ultra-fine powder with grain size smaller than 1 μm.

A magnet including ultra-fine powder is made by jet milling with different crystal grains, and then magnetic performance experiments are performed many times. As a result, the maximum grain size is set as 50 μm. The preferred powder grain size is below 30 μm, more preferably below 20 μm.

With a nuclear-generating-type coercivity mechanism, defects on the surface of each grain frequently occur in the sintered rare earth magnet when the grain size of the crystal grain increases. Generally speaking, it will make the deficiency repair performance by the R-rich phase in the sintering process less efficient, and the coercivity and squareness decrease rapidly. Hence, existence of a large grain with grain size larger than 50 μm leads to a decrease of coercivity and squareness of the sintered magnet.

The powder grain size evaluation determines the diameter of a ball equal to the powder viewed under a microscope. The reason is that if a laser reflecting method is used to characterize grain size, a small amount of the largest grain is ignored and fails to be found in a statistical process. Besides, a gas permeability method like FSSS can obtain an average grain size by a probability calculation, but the grain size of the largest grain cannot be obtained.

The rare earth magnet of the present invention contains necessary elements like R, T, and B to form the $R_2T_{14}B$ main phase. It also contains 0.01 at %~10 at % of a dopant element M, and M can be at least one of Al, Ga, Ca, Sr, Si, Sn, Ge, Ti, Bi, C, S or P.

The flow rate of the inert jet stream is 2~50 m/s.

The normal temperature dew point of the inert jet stream is below −10° C. in 0.1 MPa~1.0 MPa.

In another preferred embodiment, the rare earth magnet alloy comprises at least two kinds of rare earth magnet alloy with different rare earth components and/or contents.

In another preferred embodiment, the alloy coarse powder is obtained from an alloy by using a hydrogen decrepitation method.

In another preferred embodiment, the rare earth magnet alloy is obtained from an alloy melt liquid by strip casting and cooling at a cooling rate between $10^{2\circ}$ C./s and $10^{4\circ}$ C./s.

Another object of the present invention is to provide a method of manufacturing a rare earth magnet.

The technical proposal of the present invention follows.

A method of manufacturing a rare earth magnet, in which the rare earth magnet comprises a $R_2T_{14}B$ main phase, where R is at least one kind of rare earth element comprising yttrium, T is at least one kind of transition metal element comprising Fe and/or Co, wherein the method comprises: finely grinding at least one kind of rare earth magnet alloy or at least one kind of rare earth magnet alloy coarse powder in an inert jet stream having an oxygen content below 1000 ppm to obtain powder that has a grain size smaller than 50 μm and includes ultra-fine powder having a grain size smaller than 1 μm; and a green compact is produced by compacting the aforementioned powder; and sintering the green compact to make the rare earth magnet.

Another object of the present invention is to provide a powder making device for rare earth magnet alloy powder.

The technical proposal of the present invention follows.

A powder making device for rare earth magnet alloy powder, comprises a pulverizer, a first collecting device, a charging bucket and a compressor. The pulverizer comprises a powder inlet, an air inlet at the lower portion and an air outlet at the upper portion. The air inlet of the pulverizer is connected to the compressor, the air outlet is disposed with a first filter for powder having a grain size smaller than 50 μm. The first collecting device is disposed with an air inlet at the upper portion and an air outlet at the top portion. The air inlet is connected to the air outlet of the pulverizer by a pipe, the bottom of the first collecting device is connected to the charging bucket, wherein the air outlet of the first collecting device extends downwardly with a second filter for gas-solid separation, and is connected to the compressor, the second filter is disposed corresponding to the air inlet of the first collecting device.

The powder making device is used with a filter for gas-solid separation in the first collecting device, so that the easily oxidized ultra-fine powder is not separated in the first collecting device but mixed into the finished powder to be collected by the first collecting device.

Another technical proposal of the present invention follows.

A powder making device for a rare earth magnet alloy powder, comprises a pulverizer, a first collecting device, a charging bucket, a second collecting device and a compressor. The pulverizer comprises a powder inlet, an air inlet at the lower portion and an air outlet at the upper portion. The air inlet of the pulverizer is connected to the compressor, and the air outlet is disposed with a filter for powder with grain size smaller than 50 μm. The first collecting device is disposed with an air inlet at the upper portion and an air outlet at the top portion. The air inlet is connected to the air outlet of the pulverizer via a pipe, and the bottom of the first collecting device is connected to the charging bucket. The second collecting device is an ultra-fine powder collecting device with an air inlet at the upper portion and an air outlet at the top portion. The air inlet is connected to the air outlet of the first collecting device via a pipe, and the air outlet is connected to the compressor. The ultra-fine powder is powder having a grain size smaller than 1 μm. The second collecting device is disposed with a powder outlet at the bottom portion. The powder outlet is connected to the bottom portion of the first collecting device via a pipe with a valve.

Compared to the existing technology, the present invention has following advantages:

1) By mixing the rare earth rich ultra-fine powder that was previously discarded, the present invention has advantages including saving valuable rare earth materials and reducing costs.
2) As the oxygen content of the inert jet stream in the JM process is below 1000 ppm, oxidization of the rare earth element of the ultra-fine powder and the effective impurity rarely happen, the ultra-fine powder can serve as a sintering assistant, it can also reduce the possibility of abnormal grain growth (AGG) in the sintering process, hence improving coercivity and squareness, while also simplifying the process and reducing the manufacturing cost.
3) The ultra-fine powder contains oxygen, thus making it stable, and it contains many effective impurities like Si, Cu, Cr, Mn, S, P, etc., so that the sintered magnet made from the powder with ultra-fine powder has high corrosion resistance. The corrosion resistance is improved even without Co, thus saving a high cost and valuable Co.
4) An ultra-fine powder collecting device becomes unnecessary, so that the device is simple. It prevents severe problems like ultra-fine powder burning, device burning, or personnel burn when cleaning the device.

DETAILED DESCRIPTION OF THE INVENTION

The present invention will be further described with the embodiments, but it should be noted that it is not a limitation to the scope of the invention.

Embodiments 1-3

The present invention takes NdFeB rare earth alloy magnetic powder as an example to illustrate the manufacturing process and evaluation process for a rare earth magnet.

The manufacturing process includes the following manufacturing steps: raw material preparing→melting→casting→hydrogen decrepitation→micro grinding→pressing under a magnetic field→sintering→heat treating→magnetic property evaluation→oxygen content evaluation of the sintered magnet.

In the raw material preparing process, Nd with 99.5% purity, industrial Fe—B, and industrial pure Fe are prepared, and the weight ratio of the components is shown in TABLE 1.

TABLE 1

The weight ratio of the components.

| No. | Nd | Fe | B |
|---|---|---|---|
| Embodiment 1 | 28 | 71 | 1 |
| Embodiment 2 | 30 | 69 | 1 |
| Embodiment 3 | 33 | 66 | 1 |

Based on the above weight ratio of embodiments 1-3, 10 Kg raw materials are prepared respectively.

In the melting process, the prepared raw materials are put into a crucible made of aluminum oxide, an intermediate frequency vacuum induction melting furnace is used to melt the raw materials to 1500° C. in a $10^{-2}$ Pa vacuum.

In casting process, Ar gas is filled into the melting furnace to 10000 Pa after vacuum melting, then a centrifugal casting method is used to cast the alloy and rapidly cool the alloy at a cooling rate of 1000° C./s.

In the hydrogen decrepitation process, the crushing room with the rapidly cooled alloy is pumped at room temperature, then filled with hydrogen having a 99.5% purity to 0.1 MPa, left for 2 hours, after that, heating the crushing room and pumping at the same time, then, keeping the vacuum and 300° C. for 2 hours, and the crushed specimen having an average grain size between 200 μm~1000 μm is taken out after cooling.

Figure 2:
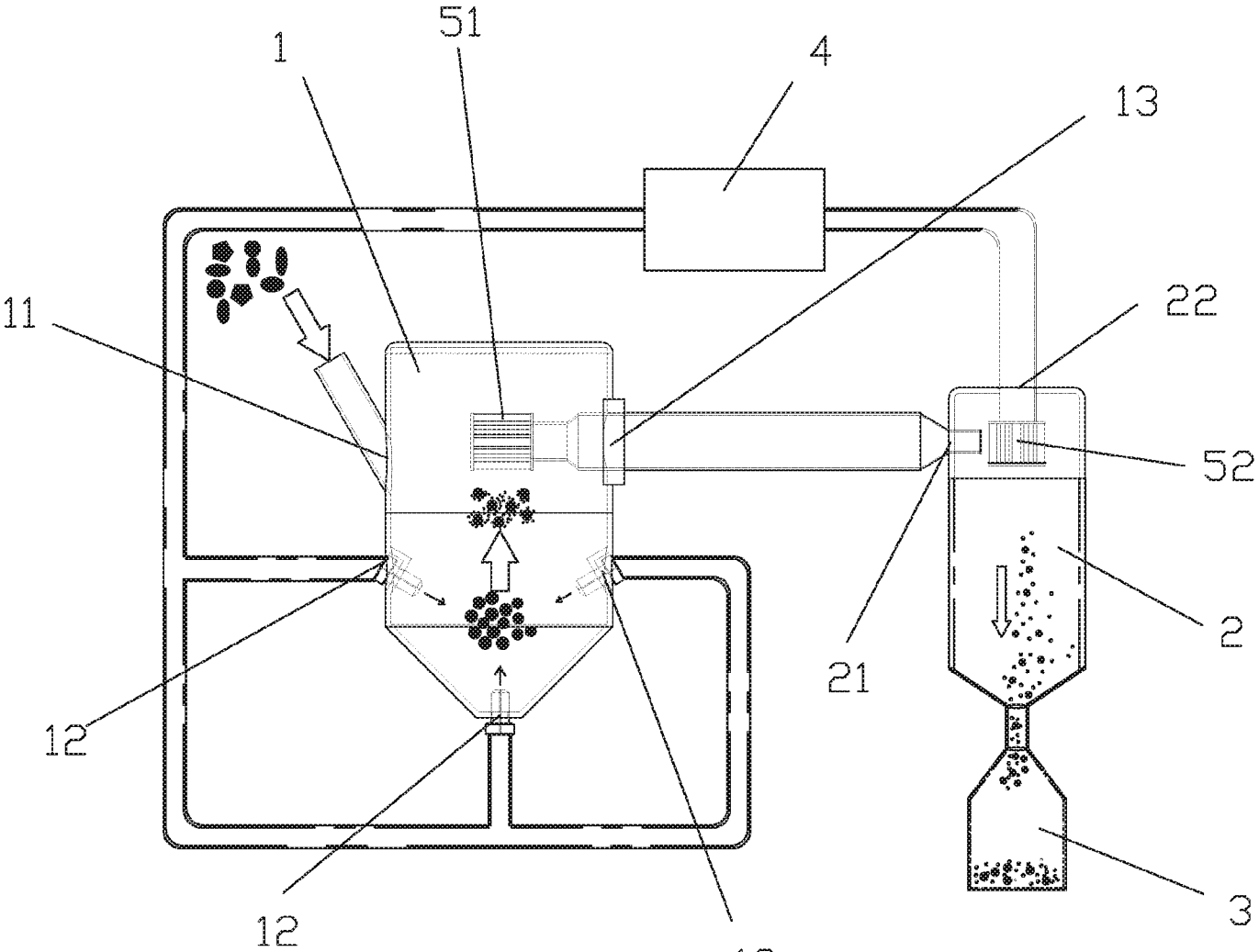
FIG. 2 illustrates a schematic diagram of the jet milling apparatus used in embodiments 1-3 and comparative examples 1-6.

In the micro grinding process, FIG. 2 shows the powder making device for this process as comprising a pulverizer 1, a first collecting device 2, a charging bucket 3 and a compressor 4. The pulverizer 1 comprises a powder inlet 11, an air inlet 12 at the lower portion and an air outlet 13 at the upper portion. The air inlet 12 of the pulverizer 1 is connected to the compressor 4, and the air outlet 13 is disposed with a first filter 51 for powder having a grain size smaller than 50 μm. The first collecting device 2 is disposed with an air inlet 21 at the upper portion and an air outlet 22 at the top portion. The air inlet 21 is connected to the air outlet 13 of the pulverizer 1 by a pipe. The bottom of the first collecting device 2 is connected to the charging bucket 3. The air outlet 22 of the first collecting device 2 extends downwardly, has a second filter 52 for gas-solid separation, and is connected to the compressor 4. The second filter 52 is disposed corresponding to the air inlet 21 of the first collecting device.

The powder after hydrogen decrepitation is put into the pulverizer 1 from the powder inlet 11. When the compressor 4 activates, inert gases recycle in the compressor 4 with the oxygen content lower than 100 ppm, the dew point is −38° C. (normal temperature 0.4 MPa), the flow rate is 5 m/s, and airflow enters the pulverizer 1 through the air inlet 12. The raw material is jet milled in a condition that the pressure of the pulverizer is 0.4 MPa, due to the work of the airflow. The ground powder having a grain size smaller than 50 μm enters the first collecting device 2 through the first filter 51 disposed at the air outlet 13 at the upper portion. Uncrushed or imperfectly crushed powder (having a grain size larger than needed) is kept in the pulverizer 1 for further jet mill crushing. Airflow with crushed powder enters the first collecting device 2, at this time, large powder drops down due to gravity, ultra-fine powder enters the air outlet 22 of the first collecting device 2 with the airflow, but since it cannot pass through the second filter 52, it is also kept in the first collecting filter 2, and is then collected into the charging bucket 3 along with the large powder. The airflow passing through the second filter 52 enters the compressor 4 for recycling.

To prevent blockage of the first filter 51 and the second filter 52, shaking machines are disposed respectively in the first filter 51 and the second filter 52 for shaking.

The crushed powder is added with a molding promoter that is sold in the market as a forming assistant. In the present invention, the molding promoter is methyl caprylate, the additive amount is 0.2% of the rare earth alloy magnetic powder, and the mixture is well blended by a V-type mixer.

In the pressing under a magnetic field process, using a right-orientation-type magnetic field molding, in a relative humidity of 1~3%, the powder is then compacted into a cube with an edge of 40 mm in a 2.0 T of orientation field and 0.8 ton/cm$^2$ of forming pressure. Then the cubes are demagnetized in a 0.2 T magnetic field.

Compacting takes place in argon atmosphere. The oxygen content stays below 1000 ppm, the forming machine is configured with a humidifier and a cooling device, and compacting takes place at a temperature of 25° C.

In the sintering process, the compacts are moved to the sintering furnace, under a vacuum of $10^{-1}$ Pa for 2 hours at 200° C. and for 2 hours at 900° C., then sintering for 2 hours at 1050° C., followed by filling the furnace with Ar gas to 0.1 MPa, and cooling to room temperature.

In the heating process, the sintered magnet is heated for 1 hour in 580° C. in high purity Ar gas, then cooled to room temperature and taken out of the furnace.

In the magnetic property evaluation process, the sintered magnet is tested by the NIM-10000H nondestructive testing of a large rare earth permanent magnet of the China Metrology Institute. The testing temperature is 20° C.

In the oxygen content of sintered magnet evaluation process, the oxygen content of the sintered magnet is measured by an EMGA-620W oxygen and nitrogen analyzer of the Japanese company HORIBA.

In the corrosion resistance performance experiment, a precision electronic balance is used to evaluate the weightlessness value (mg) of the sintered magnet for 20 days after a HSAT (IEC68-2-66) experiment.

Comparative Samples 1-6

The difference between comparative samples 1-6 from embodiments 1-3 is that, in the raw material preparing process, Nd with a 99.5% purity, industrial Fe—B, industrial pure Fe and Co with a 99.9% purity are prepared, and the weight ratio of the components is shown in TABLE 2.

TABLE 2

The weight ratio of the components.

| No. | Nd | Fe | B | Co |
|---|---|---|---|---|
| Comparative sample 1 | 28 | 71 | 1 | 0 |
| Comparative sample 2 | 30 | 69 | 1 | 0 |
| Comparative sample 3 | 33 | 66 | 1 | 0 |

TABLE 2-continued

The weight ratio of the components.

| No. | Nd | Fe | B | Co |
|---|---|---|---|---|
| Comparative sample 4 | 28 | 69 | 1 | 2 |
| Comparative sample 5 | 30 | 67 | 1 | 2 |
| Comparative sample 6 | 33 | 64 | 1 | 2 |

Based on above weight ratio of comparative samples 1-6, 10 Kg raw materials are respectively prepared.

Figure 1:
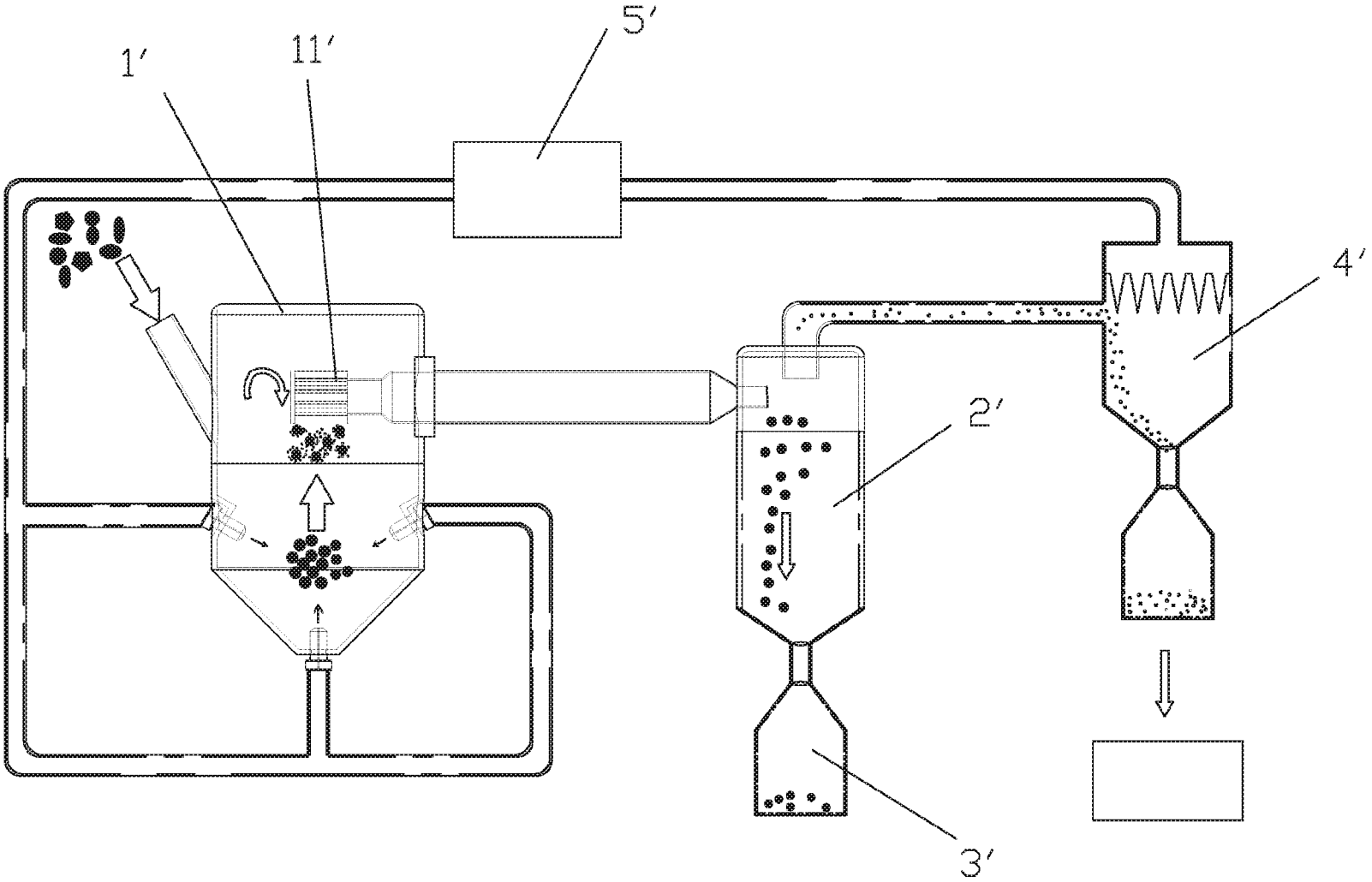
FIG. 1 illustrates a schematic diagram of an existing jet milling apparatus.

In the micro grinding process, FIG. 1 shows the powder making device which comprises a pulverizer 1', a classification device 2', a powder collecting device 3', an ultra-fine powder collecting device 4' and a compressor 5'. The pulverizer 1' is disposed with a filter 11' for powder having a grain size smaller than 20 μm. The filter 11' is connected to the air outlet of pulverizer 1'. The air inlet of pulverizer 1' is connected to compressor 5' via a pipe, and the air outlet of pulverizer 1' is connected to the classification device 2' via a pipe. The classification device 2' is connected to the powder collecting device 3' and the ultra-fine powder collecting device 4' respectively. In the powder making process, the coarse powder (as raw material) is put into the pulverizer 1' through the raw material inlet. The compressor 5' activates to cycle air and air enters the pulverizer 1' via the air inlet of the pulverizer 1'. In an inert jet steam having an oxygen content below 1000 ppm, a dew point −38° C. (normal temperature, 0.4 MPa), a flow rate of 5 m/s, and a pressure of the pulverizer is 0.4 MPa, the raw material is jet milled. Powder with a grain size smaller than 50 μm enters the classification devices 2' for classification through the first filter 11' disposed at the air outlet of the pulverizer at the upper portion under the force of the airflow. The uncrushed powder or imperfectly crushed powder are kept in the pulverizer 1' for further jet mill crushing. In the classification device 2', using a classification process, the ultra-fine powder enters the ultra-fine powder collecting device 4' via a pipe, the finished powder enters the powder collecting device 3' for subsequent processing. In the ultra-fine powder collecting device 4', the gas and the ultra-fine powder are separated. The air outlet of the ultra-fine powder device 4' is connected to the compressor 5' via a pipe, the gas recycles via compressor 5', and the ultra-fine powder is kept in the ultra-fine powder collecting device 4'. It should be noted that, the ultra-fine powder is powder having a grain size smaller than 1 μm. The ultra-fine powder collected by the ultra-fine powder collecting device 4' is discarded.

The discard rate of ultra-fine powder (%) is determined by calculating the powder weight of the ultra-fine powder collecting device 4' divided by the raw material weight and expressed as a percentage.

TABLE 3 is a magnetic property comparison TABLE between the embodiments and the comparative samples.

TABLE 3

Magnetic property comparison TABLE.

| No. | Discard rate of ultrafine powder (%) | Br (kGs) | Hcj (k0e) | Hk/Hcj (%) | (BH)max (MG0e) | HAST weight-lessness (mg) | Oxygen Content of the Sintered magnet (ppm) |
|---|---|---|---|---|---|---|---|
| Embodiment 1 | 0 | 14.6 | 12.3 | 97.8 | 51.4 | 1.8 | 920 |
| Embodiment 2 | 0 | 13.8 | 15.2 | 97.9 | 46.6 | 1.8 | 965 |
| Embodiment 3 | 0 | 13.3 | 17.3 | 98.2 | 43.7 | 1.9 | 981 |
| Comparative sample 1 | 0.9 | 14.5 | 11.3 | 86.5 | 50.2 | 25.2 | 865 |
| Comparative sample 2 | 1.2 | 13.7 | 14.2 | 87.5 | 45.1 | 28.5 | 873 |
| Comparative sample 3 | 3.2 | 13.2 | 16.5 | 88.3 | 42.1 | 32.6 | 883 |
| Comparative sample 4 | 2.1 | 14.5 | 10.2 | 78.5 | 50.4 | 6.2 | 913 |
| Comparative sample 5 | 2.8 | 13.7 | 13.1 | 79.2 | 45.1 | 7.5 | 925 |
| Comparative sample 6 | 3.9 | 13.2 | 15.3 | 78.9 | 42.2 | 8.9 | 940 |

Embodiments 4-6

The difference between the embodiments 4-6 and embodiments 1-3 is that, in the raw material preparing process, Nd with 99.5% purity, industrial Fe—B, industrial pure Fe are prepared, the weight ratio of the components is shown in TABLE 4.

TABLE 4

The weight ratio of the components.

| No. | Nd | Fe | B |
|---|---|---|---|
| Embodiment 4 | 28 | 71 | 1 |
| Embodiment 5 | 30 | 69 | 1 |
| Embodiment 6 | 33 | 66 | 1 |

Based on above weight ratio of embodiments 4-6, 10 Kg raw materials were respectively prepared.

Figure 3:
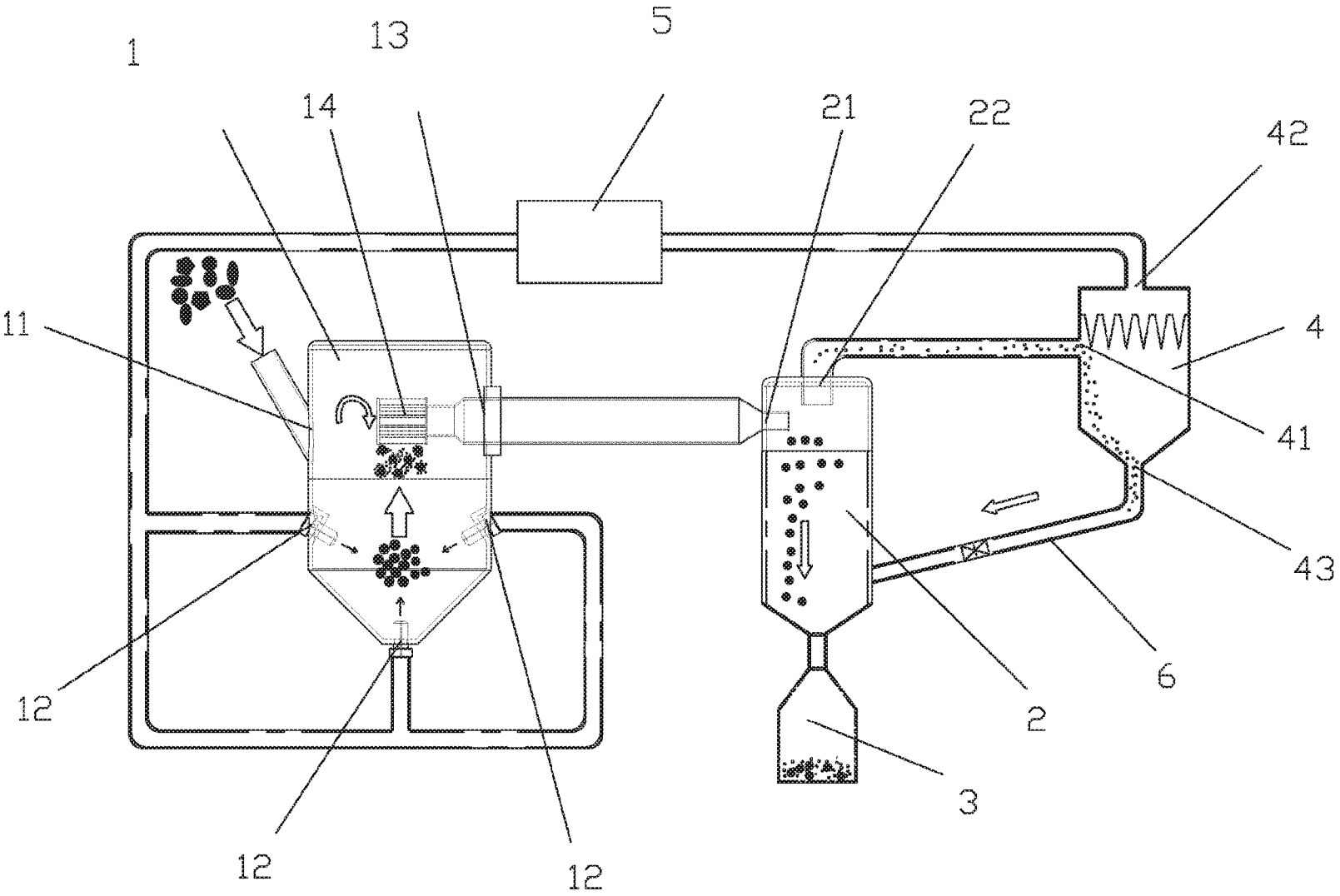
FIG. 3 illustrates a schematic diagram of the jet milling apparatus used in embodiments 4-6 and comparative examples 7-12.

The powder making device in this micro grinding process is shown in FIG. 3 and comprises a pulverizer 1, a first collecting device 2, a charging bucket 3, a second collecting device 4 and a compressor 5. The pulverizer 1 comprises a powder inlet 11, an air inlet 12 at the lower portion and an air outlet 13 at the upper portion. The air inlet 12 of the pulverizer 1 is connected to the compressor 5, and the air outlet 13 is disposed with a first filter 14 for powder having a grain size smaller than 20 μm. The first collecting device 2 is disposed with an air inlet 21 at the upper portion and an air outlet 22 at the top portion. The air inlet 21 is connected to the air outlet 13 of the pulverizer 1 via a pipe. The bottom of the first collecting device 2 is connected to the charging bucket 3. The second collecting device 4 is an ultra-fine powder collecting device and is disposed with an air inlet 41 at the upper portion and an air outlet at the top portion. The air inlet 41 is connected to the air outlet 22 of the first collecting device 2, and the air outlet 42 is connected to the compressor 5. The second collecting device 4 is disposed with a powder outlet 43 at the bottom. The powder outlet 43 is connected to the bottom of the first collecting device 2 via a pipe with valve.

The powder after hydrogen decrepitation is put into the pulverizer 1 from the powder inlet 11. When the compressor 5 activates, inert gases recycles in compressor 4 with an oxygen content between 500 ppm-1000 ppm, a dew point of −10° C. (normal temperature 1.0 MPa), a flow rate of 50 m/s, with the pressure of the pulverizer being 1.0 MPa. Under the force of the airflow, the ground powder with grain size smaller than 20 μm enters the first collecting device 2 through the filter 14 disposed at the air outlet 13 at the upper portion. Uncrushed or imperfectly crushed powder (with grain size larger than needed) are kept in the pulverizer 1 for further jet mill crushing. Airflow including crushed powder enters the first collecting device 2. At this time, large powder drops down due to gravity, ultra-fine powder enters the air outlet 22 of the first collecting device 2 with the airflow, and then enters the second collecting device 4. In the second collecting device, ultra-fine powder is collected and enters the bottom of the first collecting device 2 via powder outlet 43, is mixed with the large powder collected in the first collecting device 2, and the powder then enters the charging bucket 3. The airflow passing through the second collecting device 4 flows to the compressor 5 for recycling.

Comparative Samples 7-12

The difference of the comparative samples 7-12 and comparative samples 1-6 is that, in the raw material preparing process, Nd with 99.5% purity, industrial Fe—B, industrial pure Fe and Co with 99.9% purity are prepared, and the weight ratio of the components is shown in TABLE 5.

TABLE 5

The weight ratio of the components.

| No. | Nd | Fe | B | Co |
|---|---|---|---|---|
| Comparative sample 7 | 28 | 71 | 1 | 0 |
| Comparative sample 8 | 30 | 69 | 1 | 0 |
| Comparative sample 9 | 33 | 66 | 1 | 0 |
| Comparative sample 10 | 28 | 69 | 1 | 2 |
| Comparative sample 11 | 30 | 67 | 1 | 2 |
| Comparative sample 12 | 33 | 64 | 1 | 2 |

Based on above weight ratio of comparative samples 7-12, 10 Kg raw materials are respectively prepared.

In the micro grinding process, FIG. 1 shows the powder making device. The device comprises a pulverizer 1', a classification device 2', a powder collecting device 3', an ultra-fine powder collecting device 4' and a compressor 5'. The pulverizer 1' is disposed with a filter 11' for powder with grain size smaller than 20 μm. The filter 11' is connected to the air outlet of the pulverizer 1'. The air inlet of the pulverizer 1' is connected to the compressor 5' via a pipe, and the air outlet of the pulverizer 1' is connected to the classification device 2' via a pipe. The classification device 2' is connected to the powder collecting device 3' and the ultra-fine powder collecting device 4' respectively. In the powder making process, the coarse powder (as raw material) is put into the pulverizer 1' through the raw material inlet. The compressor 5' activates to cycle air, and air enters the pulverizer 1' from the air inlet of the pulverizer 1'. In an inert jet steam with an oxygen content of 500 ppm~1000 ppm, a dew point of −10° C. (normal temperature, 1.0 MPa), a flow rate of 5 m/s, and a the pressure of the pulverizer is 1.0 MPa, the raw material is jet milled. Powder with a grain size smaller than 20 μm enters the classification devices 2' for classification through the first filter 11' disposed at the air outlet of the pulverizer at the upper portion under the force of the airflow. The uncrushed powder or imperfectly crushed powder are kept in the pulverizer 1' for continuing jet mill crushing. In the classification device 2', using a classification process, the ultra-fine powder enters the ultra-fine powder collecting device 4' via a pipe, the finished powder enters the powder collecting device 3' for a subsequent process. In the ultra-fine powder collecting device 4', gas and the ultra-fine powder are separated. The air outlet of the ultra-fine powder device 4' is connected to the compressor 5' via a pipe, and the gas recycles via compressor 5'. The ultra-fine powder is kept in the ultra-fine powder collecting device 4'. It is noted that, ultra-fine powder is powder having a grain size smaller than 1 μm. The ultra-fine powder collected by the ultra-fine powder collecting device 4' is discarded.

The discard rate of ultra-fine powder (%) is determined by calculating the powder weight of the ultra-fine powder collecting device 4' divided by the raw material weight expressed as a percentage.

TABLE 6 is a magnetic property comparison TABLE between the embodiments and the comparative samples.

TABLE 6

Magnetic property comparison TABLE.

| No. | Discard rate of ultra fine powder (%) | Br (kGs) | Hcj (k0e) | Hk/Hcj (%) | (BH)max (MG0e) | HAST weight-lessness (mg) | Oxygen Content of the Sintered magnet (ppm) |
|---|---|---|---|---|---|---|---|
| Embodiment 4 | 0 | 14.5 | 12.1 | 98.2 | 50.8 | 1.7 | 925 |
| Embodiment 5 | 0 | 13.7 | 15.3 | 98.1 | 46.0 | 1.6 | 940 |
| Embodiment 6 | 0 | 13.4 | 17.4 | 97.9 | 44.4 | 1.7 | 970 |
| Embodiment 7 | 0.8 | 14.4 | 11.2 | 85.5 | 49.4 | 30.2 | 898 |
| Comparative sample 8 | 1.3 | 13.6 | 14.1 | 83.2 | 44.5 | 32.6 | 923 |
| Comparative sample 9 | 3.1 | 13.0 | 15.9 | 83.9 | 40.8 | 36.3 | 940 |
| Comparative sample 10 | 2.0 | 14.4 | 9.9 | 74.3 | 49.4 | 7.4 | 933 |
| Comparative sample 11 | 2.7 | 13.7 | 12.8 | 76.8 | 45.0 | 6.9 | 942 |
| Comparative sample 12 | 4.2 | 13.1 | 14.9 | 72.3 | 41.6 | 7.3 | 935 |

Although the present invention has been described with reference to the preferred embodiments thereof for carrying out the invention, it will be apparent to those skilled in the art that a variety of modifications and changes may be made without departing from the scope of the patent for invention which is intended to be defined by the appended claims

INDUSTRIAL APPLICABILITY

The present invention is a method of manufacturing a rare earth magnet alloy powder, a rare earth magnet, and a powder making device in which ultra-fine powder having a grain size smaller than 1 μm is not separated from the crushed powder having a low oxygen content from the pulverizer, the oxygen content in the pulverizer is reduced to below 1000 ppm during crushing so that, in the subsequent sintering process, abnormal grain growth (AGG) rarely happens in the sintered magnet having a low oxygen content, the processes are simplified, and manufacturing costs are reduced.

The invention claimed is:

1. A method of manufacturing a rare earth magnet alloy powder for a rare earth magnet, the method comprising:

receiving at least one kind of rare earth magnet alloy through a powder inlet of a pulverizer of a powder making device; and grinding the at least one kind of rare earth magnet alloy in the powder making device using an inert jet stream to obtain the rare earth magnet alloy powder, wherein:

the inert jet stream comprises at least one inert gas and has an oxygen content below 1000 ppm, and grinding the at least one kind of rare earth magnet alloy in the powder making device using an inert jet stream comprises:

injecting the at least one inert gas into the pulverizer through at least one air inlet;

using a first filter disposed within the pulverizer to filter powder having a grain size smaller than 50 μm from powder having a grain size larger than 50 μm;

passing the at least one inert gas and the powder having the grain size smaller than 50 μm from the pulverizer to a first collecting device;

sorting the powder having the grain size smaller than 50 μm from the at least one inert gas;

collecting fine powder, having a grain size smaller than 50 μm and greater than 1 μm, in a charging bucket disposed at a bottom of the first collecting device; and collecting ultra-fine powder, having a grain size smaller than 1 μm, in the charging bucket disposed at the bottom of the first collecting device.

2. The method of claim 1, wherein the sorting the powder having the grain size smaller than 50 μm from the at least one inert gas comprises:

sorting the fine powder from the ultra-fine powder; and passing the at least one inert gas and the ultra-fine powder from the first collecting device to a second collecting device.

3. The method of claim 2, wherein collecting the ultra-fine powder comprises:

sorting the at least one inert gas from the ultra-fine powder; and passing the ultra-fine powder from the second collecting device to the first collecting device.

4. The method of claim 3, wherein passing the ultra-fine powder from the second collecting device to the first collecting device comprises:

passing the ultra-fine powder from the second collecting device to the first collecting device through a first pipe connected to a bottom of the second collecting device and connected to a lower portion of the first collecting device.

5. The method of claim 4, wherein passing the at least one inert gas and the ultra-fine powder from the first collecting device to a second collecting device comprises:

passing the at least one inert gas and the ultra-fine powder from the first collecting device to a second collecting device through a pipe connected to a top of the first collecting device.

6. The method of claim 4, further comprising:

using a valve, disposed in the first pipe, to control movement from the ultra-fine powder from the second collecting device to the first collecting device.

7. The method of claim 3, further comprising:

passing the at least one inert gas from the second collecting device to a compressor; and passing the at least one inert gas from the compressor to the at least one air inlet of the pulverizer.

8. The method of claim 1, wherein sorting the powder having the grain size smaller than 50 μm from the at least one inert gas comprises:

sorting the powder having the grain size smaller than 50 μm from the at least one inert gas comprises using a second filter disposed within the first collecting device.

9. The method of claim 8, further comprising:

passing the at least one inert gas from the first collecting device to a compressor; and passing the at least one inert gas from the compressor to the at least one air inlet of the pulverizer.

10. The method of claim 1, wherein:

the at least one kind of rare earth magnet alloy constituted to provide a rare earth magnet that comprises a $R_2T_{14}B$ main phase, where R is at least one kind of rare earth element and T is at least one kind of transition metal element comprising Fe but no Co, and the at least one kind of rare earth magnet alloy is received in a strip or coarse powder form.

11. The method of claim 1, wherein receiving the at least one kind of rare earth magnet alloy through the powder inlet of the pulverizer of the powder making device comprises:

receiving the at least one kind of rare earth magnet alloy after hydrogen decrepitation has been performed on the at least one kind of rare earth magnet alloy.

12. The method of claim 1, wherein:

injecting the at least one inert gas into the pulverizer through at least one air inlet comprises injecting the at least one inert gas into the pulverizer through at least three air inlets, the at least one inert gas is injected into the pulverizer through a first air inlet of the at least three air inlets in a first direction toward the first filter, the at least one inert gas is injected into the pulverizer through a second air inlet of the at least three air inlets in a second direction toward the first air inlet, the at least one inert gas is injected into the pulverizer through a third air inlet of the at least three air inlets in a third direction toward the first air inlet, and the third direction is different than the second direction.

13. The method of claim 1, further comprising:

pressing and sintering the rare earth magnet alloy powder, including the fine powder and ultra-fine powder.

14. The method of claim 1, wherein the at least one inert gas has a normal temperature dew point of below −10° C. in 0.1 MPa to about 1.0 MPa.

15. The method of claim 1, wherein injecting the at least one inert gas into the pulverizer through at least one air inlet comprises injecting the at least one inert gas into the pulverizer at a flow rate of about 50 m/s.

16. A method of manufacturing a rare earth magnet alloy powder for a rare earth magnet, the method comprising:

receiving at least one kind of rare earth magnet alloy through a powder inlet of a pulverizer of a powder making device, wherein the at least one kind of rare earth magnet alloy is constituted to provide a rare earth magnet that comprises a $R_2T_{14}B$ main phase, where R is at least one kind of rare earth element and T is at least one kind of transition metal element comprising Fe but no Co; and grinding the at least one kind of rare earth magnet alloy in the powder making device using an inert jet stream to obtain the rare earth magnet alloy powder, wherein:

the inert jet stream comprises at least one inert gas and has an oxygen content below 1000 ppm, and grinding the at least one kind of rare earth magnet alloy in the powder making device using an inert jet stream comprises:

injecting the at least one inert gas into the pulverizer through at least one air inlet disposed within a lower portion of the pulverizer;

using a first filter disposed within an upper portion the pulverizer to filter powder having a grain size smaller than 50 μm from powder having a grain size larger than 50 μm;

passing the at least one inert gas and the powder having the grain size smaller than 50 μm from an air outlet, disposed within the upper portion of the pulverizer, to an air inlet of a first collecting device, disposed within an upper portion of the first collecting device;

sorting the powder having the grain size smaller than 50 μm from the at least one inert gas;

collecting fine powder, having a grain size smaller than 50 μm and greater than 1 μm, in a charging bucket disposed at a bottom of the first collecting device; and collecting ultra-fine powder, having a grain size smaller than 1 μm, in the charging bucket disposed at the bottom of the first collecting device.

17. The method of claim 16, wherein the sorting the powder having the grain size smaller than 50 μm from the at least one inert gas comprises:

sorting the fine powder from the ultra-fine powder in the first collecting device; and passing the at least one inert gas and the ultra-fine powder from an air outlet of the first collecting device, disposed in a top of the first collecting device, to an air inlet of a second collecting device, disposed in an upper portion of the second collecting device.

18. The method of claim 17, wherein collecting the ultra-fine powder comprises:

sorting the at least one inert gas from the ultra-fine powder in the second collecting device; and passing the ultra-fine powder from a powder outlet disposed at a bottom of the second collecting device to the first collecting device through a pipe connected to a lower portion of the first collecting device.

19. The method of claim 16, further comprising:

pressing and sintering the rare earth magnet alloy powder, including the fine powder and ultra-fine powder.

20. A method of manufacturing a rare earth magnet alloy powder for a rare earth magnet, the method comprising:

grinding at least one kind of rare earth magnet alloy in a powder making device using an inert jet stream, wherein:

the at least one kind of rare earth magnet alloy is constituted to provide a rare earth magnet that comprises a $R_2T_{14}B$ main phase, where R is at least one kind of rare earth element and T is at least one kind of transition metal element comprising Fe but no Co, and grinding the at least one kind of rare earth magnet alloy in the powder making device using the inert jet stream, comprises:

injecting at least one inert gas into a pulverizer through at least one air inlet disposed within a lower portion of the pulverizer;

using a first filter disposed within an upper portion the pulverizer to filter powder having a grain size smaller than 20 μm from powder having a grain size larger than 20 μm;

passing the at least one inert gas and the powder having the grain size smaller than 20 μm from an air outlet of the pulverizer, disposed within the upper portion of the pulverizer, to an air inlet of a first collecting device, disposed within an upper portion of the first collecting device;

sorting the powder having the grain size smaller than 20 μm from the at least one inert gas;

collecting fine powder, having a grain size smaller than 20 μm and greater than 1 μm, in a charging bucket disposed at a bottom of the first collecting device; and collecting ultra-fine powder, having a grain size smaller than 1 μm, in the charging bucket disposed at the bottom of the first collecting device.

* * * * *